US006679466B2

(12) United States Patent
Brown

(10) Patent No.: US 6,679,466 B2
(45) Date of Patent: Jan. 20, 2004

(54) CAMMING DEVICES

(75) Inventor: Kevin Brown, Warrington (GB)

(73) Assignee: Wild Country Limited (GB)

( * ) Notice: Subject to any disclaimer, the term of this patent is extended or adjusted under 35 U.S.C. 154(b) by 0 days.

(21) Appl. No.: 10/007,780

(22) Filed: Nov. 13, 2001

(65) Prior Publication Data

US 2002/0162927 A1 Nov. 7, 2002

(30) Foreign Application Priority Data

Nov. 15, 2000 (GB) ..... 0027869

(51) Int. Cl.[7] ..... A47F 5/08
(52) U.S. Cl. ..... 248/231.9
(58) Field of Search ..... 248/231.9, 925, 248/694; 482/37

(56) References Cited

U.S. PATENT DOCUMENTS 4,184,657 A * 1/1980 Jardine ..... 248/231.9
4,565,342 A * 1/1986 Grow ..... 248/231.9
4,575,032 A * 3/1986 Taylor ..... 248/231.9
4,643,377 A * 2/1987 Christianson ..... 348/231.9
4,645,149 A * 2/1987 Lowe ..... 348/231.9
4,712,754 A * 12/1987 Brodie ..... 248/231.9
4,781,346 A * 11/1988 Banner ..... 248/231.9
RE33,104 E * 10/1989 Taylor ..... 248/231.2
5,860,629 A * 1/1999 Reed ..... 248/231.9
6,042,069 A * 3/2000 Christianson ..... 248/231.9
6,375,139 B1 * 4/2002 Murray et al. ..... 248/231.9

FOREIGN PATENT DOCUMENTS

GB 2 158 540 A * 11/1985

* cited by examiner

*Primary Examiner*—Leslie A. Braun
*Assistant Examiner*—Kofi Schulterbrandt
(74) *Attorney, Agent, or Firm*—Webb Ziesenheim Logsdon Orkin & Hanson, P.C.

(57) ABSTRACT

A camming device comprises a stem, one or more spindles mounted on the support, at least two cam members adapted to engage the walls of a crack or hole by their cam profiles pivotally mounted on the spindle or spindles and adapted for opposite pivotal movement from a closed position to an open position, means to apply a force to each cam member to urge it to its open position, means for pivoting the cams to the closed position, characterised in that the stem includes means for movement of at least a major part thereof about an axis other than that of the or of either spindle.

12 Claims, 9 Drawing Sheets

150
152
154
156
158
160
156
152

CAMMING DEVICES

This invention relates to camming devices, especially of the type used in climbing applications.

Camming devices, such as those known as 'Friends', are used to make a secure location for ropes for rock climbing. These devices are securable in cracks and the like in rock faces. A camming device generally comprises a stem carrying a transverse spindle on which are two or more, usually three or four cams that are oppositely urged to a widest extent and means for retracting the cams to a narrower extent. The known camming devices fall into three main categories, namely those that have a hooped stem and a single spindle, those that have a single stem and a single spindle and those that have a single stem and twin spindles. To use such devices, the cams are retracted, so that the cams can be pushed into a crack in a rock face and then released to grip the sides of the crack. The shaping of the cams is such that the more force is applied to pull the device out of the crack increases their grip.

There are a certain disadvantages with all such devices. Under certain conditions, there is a tendency for camming devices to 'walk' due to the effect of the forces applied to the device. The device tends to move further into the crack than originally positioned. This is undesirable, since it adds unpredictability to the holding power, especially if the device moves into a wider part of the crack. Also, the device may become irretrievable, if it walks too far to operate the trigger for retracting the cams.

A further disadvantage occurs with twin spindle camming devices. It is possible to position such devices in such a manner that the load exerted on the stem in the plane of the cams, such as for example when a climber attached to the device falls, can result in forces acting against the preferred camming action of the device and consequently compromise the holding power and safety of the device.

An object of this invention is to provide an improved camming device, especially for use in climbing applications.

According to this invention a camming device comprises a support, one or more spindles mounted on the support, at least two cam members adapted to engage the walls of a crack or hole by their cam profiles pivotally mounted on the spindle or spindles and adapted for opposite pivotal movement from a closed position to an open position, means to apply a force to each cam member to urge it to its open position, means for pivoting the cams to the closed position, characterised in that the stem includes means for movement of at least a major part thereof about an axis other than that of the or of either spindle.

In a first preferred embodiment of the invention, the camming device has one or two spindles and the or each spindle is mounted through a head of the stem, the remainder of the stem being pivotable relative to the head. Pivoting may be in a plane parallel to the cams. Alternatively, the stem may be pivotable in any direction radially of the axis of the stem. Another option is for the stem to be pivotable axially of the stem.

In a second preferred embodiment, the camming device of the invention has a single spindle and the spindle is mounted through an aperture in the stem head that is sufficiently large for limited rocking movement of the stem about the spindle, especially laterally relative to the cams. The aperture is preferably elongate along the axis of the stem. Rocking movement is preferably constrained by spring means or the like between the spindle and one end, preferably the end remote from the spindle end of the stem, of the aperture.

In a third preferred embodiment of the invention, the camming device has a stem in the form of a hoop, typically of wire and the hoop is pivotally attached at opposite sides to spindle mounts for movement parallel to the planes of the cams.

The camming devices of the present invention have in essence a greater degree of flexibility for the stem, which can reduce the tendency of camming devices to walk into cracks by taking up some or all of the forces exerted on the stem that would otherwise tend to cause walking. Alternatively or additionally side loads on stems of camming devices that can result in forces acting against the camming action may be reduced in effect.

This invention will now be further described, by way of example only, with reference to the accompanying drawings, in which.

Figure 1:
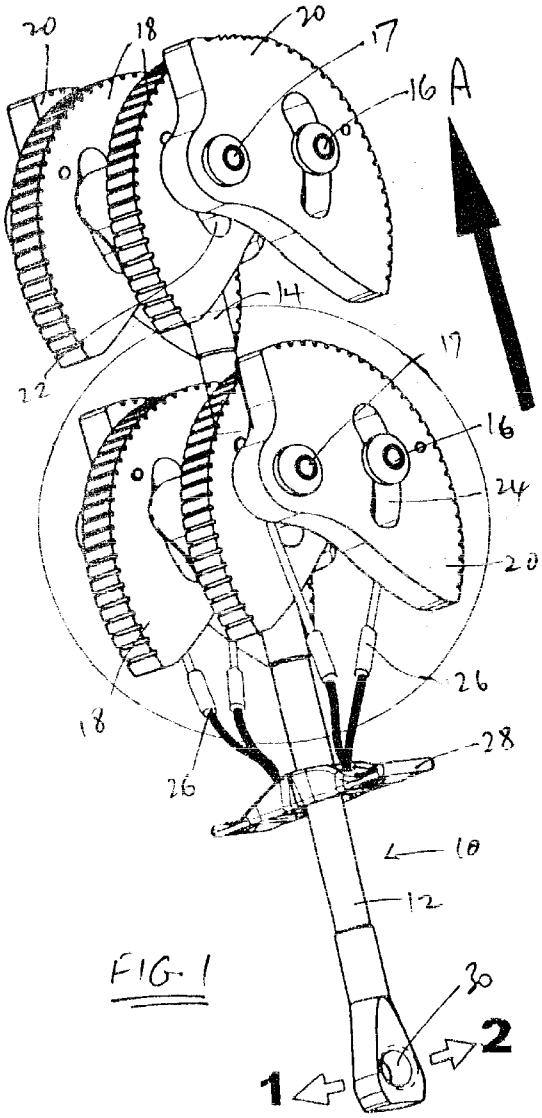
FIG. 1 shows a first prior art camming device.

Referring to FIG. 1 of the accompanying drawings, a prior art camming device 10 for use in climbing applications comprises a stem 12 having a head 14 through which are mounted a pair of spindles 16,17. The stem may be rigid or semi-rigid. The latter type of stem is usually made from wire cable and does not normally flex unless fall loads are applied. Pivotally mounted on the spindles are two pairs of inner and outer oppositely oriented cams 18,20. The inner pair of cams 18 pivot about one spindle 16 and have arcuate slots 22 to allow them to pivot relative to the other spindle 17. Similarly, the outer pair of cams 20 pivot about the other spindle 17 and have arcuate slots 24 to allow them to pivot relative to the first spindle 16.

The cams are biased towards an open position, i.e. to their greatest extent, by springs between each pair of adjacent inner and outer cams 18,20. The arcuate slots 22, 24 prevent over-rotation of the cams. The cams are also connected by wires 26 to a lever 28 slidably mounted on the stem in order to enable the cams to be drawn to a closed position by pulling on the lever. In the closed position the cams cover a lesser extent than in the open position, whereby the camming device can be inserted into a crack, hole or fissure in a rock face. Then, upon release of the lever, the cams return to their open position to grip the sides of the crack or the like, The shapes of the cams means that as force is applied to pull the camming device out of the crack, the gripping force is increased. The free end of the stem has a through hole 30 to which can be attached a loop or the like for attachment of ropes or other equipment.

A problem with prior art devices of the type shown in FIG. 1 of the drawings is that of walking. When side loads are applied to the stem, as indicated by arrows 1 and 2 in the drawing, there is a tendency for the cams to walk into a crack i.e. in the direction indicated by arrow A. That can affect the holding power of the device, because generally cracks in rock faces do not have uniform widths. Furthermore, it is possible for a camming device to walk so far into a crack that it cannot be retrieved.

Figure 2:
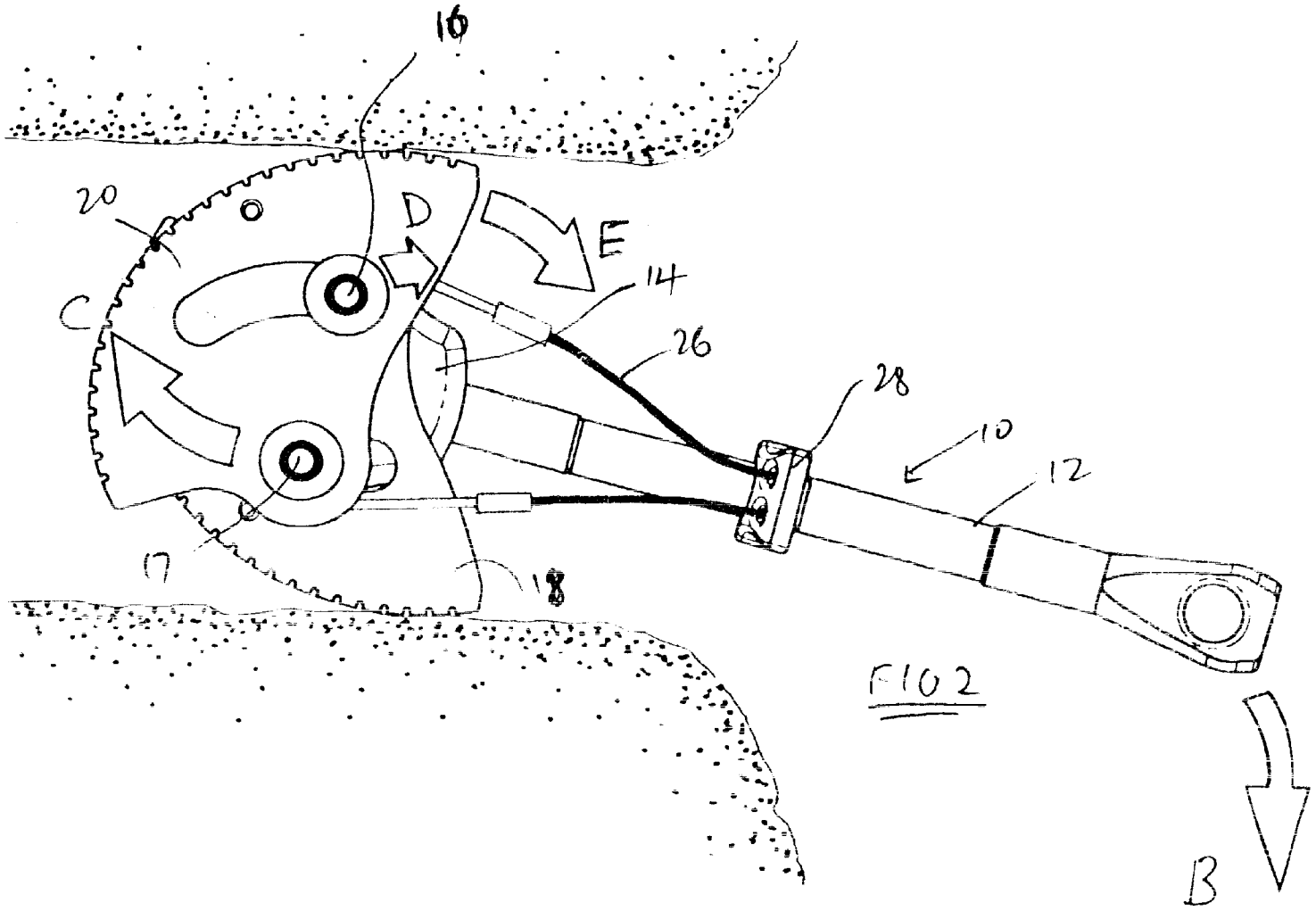
FIG. 2 shows the camming device of FIG. 1 inserted into a crack in a rock face.

FIG. 2 of the drawings illustrates another problem with prior art camming devices of this type. Loads exerted on the stem in the direction of the planes of the cams as indicated by arrow B can result in forces acting against the camming action as indicated by arrows C and, D and E, i.e. forces that tend to force the cams to wards a closed position.

Figure 3:
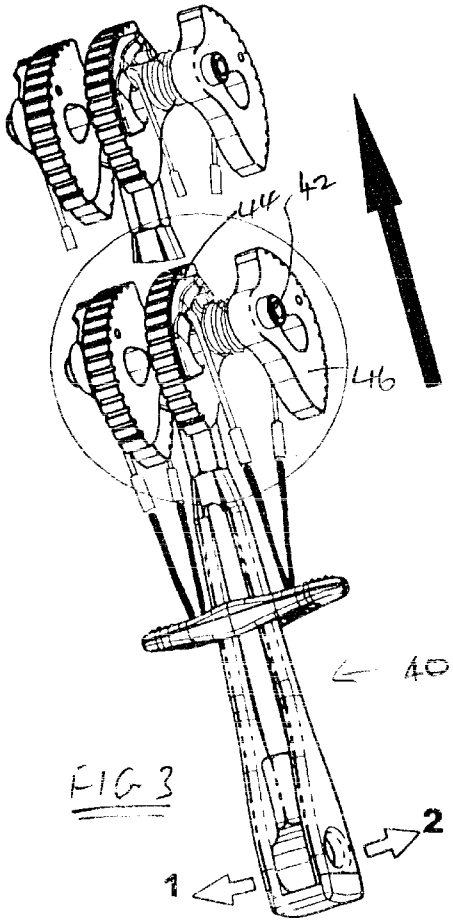
FIG. 3 shows a second prior art camming device.

FIG. 3 of the accompanying drawings shows another type of prior art camming device 40. This device differs from that of FIG. 1 by only having a single spindle 42 on which two pairs of inner and outer cams 44,46 respectively are mounted. The camming device 40 operates in the same manner as that of FIG. 1 and suffers from the same problem of walking, as indicated by the arrows.

Figure 4:
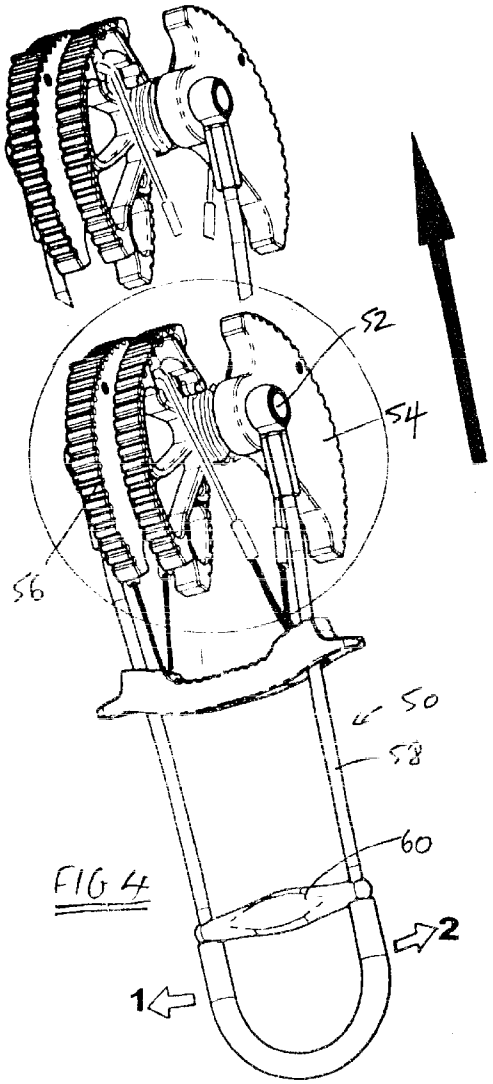
FIG. 4 shows a third prior art camming device.

Turning to FIG. 4 of the accompanying drawings, another prior art camming device 50 is shown. This device again has a single spindle 52 on which are mounted pairs of cams 54,56. Instead of a rigid or semi-rigid stem, the device has a stem in the form of a wire hoop 58 that is pivotally attached to opposite ends of the spindle 52. In other respects this device operates in a similar manner to those previously described in relation to FIGS. 1, and 3. Near its closed end the hoop 58 has a cross bar 60 to define an aperture for attachment of a loop, rope or other equipment.

As with the other prior art camming devices described, the problem of walking exists with the device 50.

Figure 6:
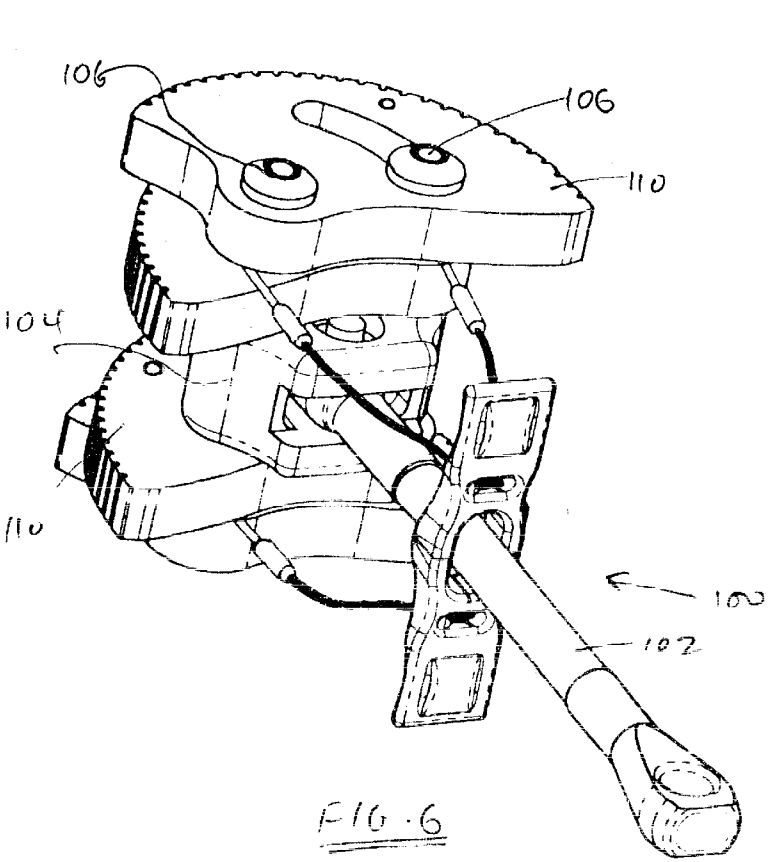
FIGS. 5 and 6 are respectively front and perspective views of a first camming device according to the invention.
Figure 5:
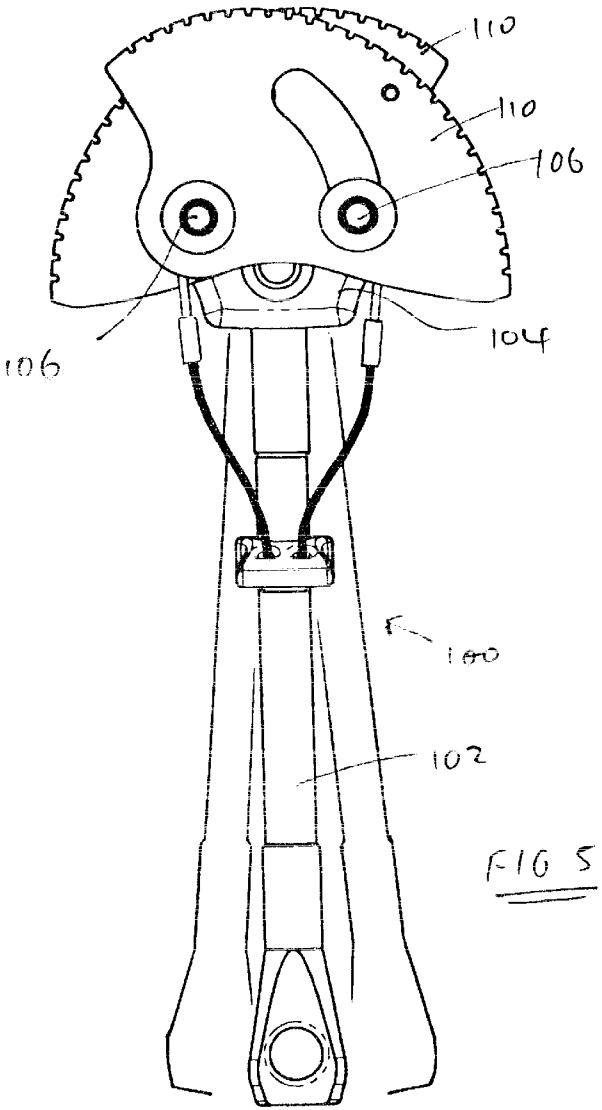

Referring now to FIGS. 5 and 6 of the drawings, which illustrates a camming device according to the invention designated 100, the device has a rigid or semi-rigid stem 102, which is pivotally mounted in a head member 104. The head member 104 receives a pair of spindles 106, on which are pivotally mounted two pairs of cams 110 either side of the head member. The cams operate in the same manner as in the prior art device shown in FIG. 1 of the drawings. The stem is arranged to pivot in a plane parallel to those in which the cams pivot relative to the spindles. Spring loading may be provided between the stem and the head member 104 in order to bias the stem to the rest position shown in FIG. 5.

Figure 7:
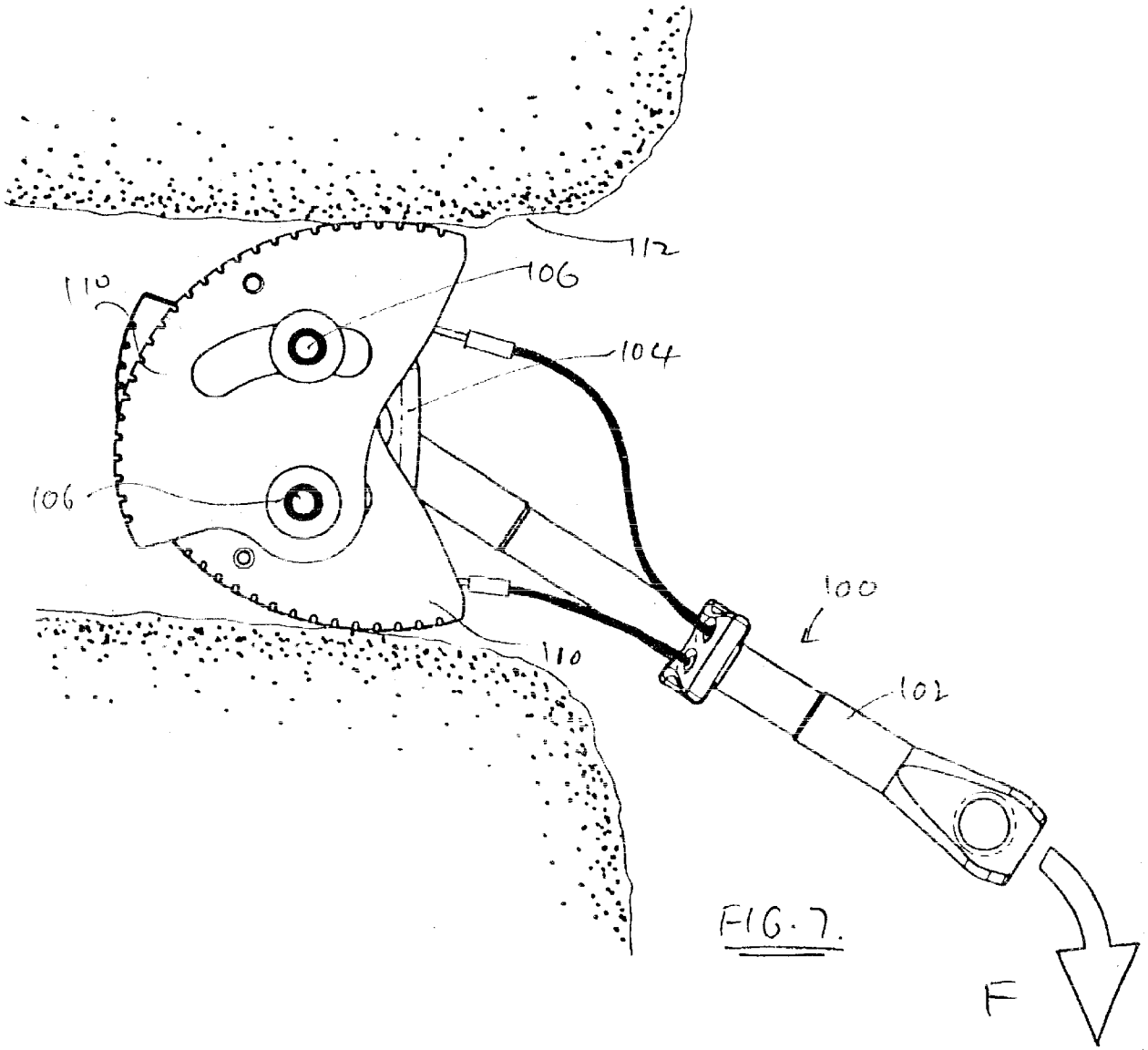
FIG. 7 shows the camming device of FIGS. 5 and 6 inserted into a crack in a rock face.

As shown in FIG. 7 of the drawings, when the device 100 is inserted into a crack 112, because the stem is able to pivot relative to the head member, the problem illustrated in FIG. 2 of the drawings with regard to the prior art device, is at least lessened. The stem is able to pivot further before any load on the stem in the direction of arrow F is transferred to the cams as forces C, D and E as shown in FIG. 2.

Figure 9:
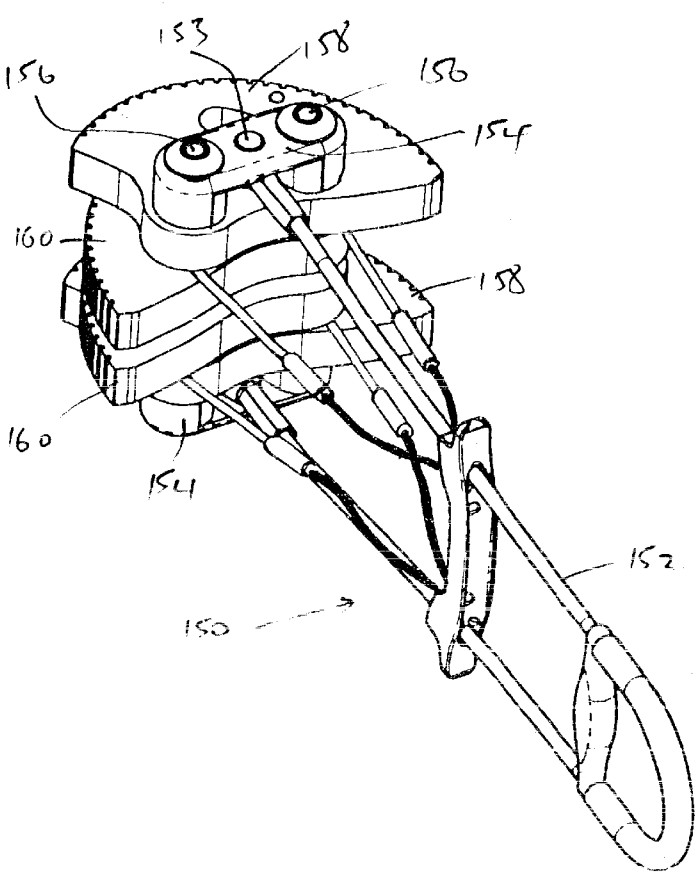
FIGS. 8 and 9 are front and perspective views of a second camming device according to the invention.
Figure 8:
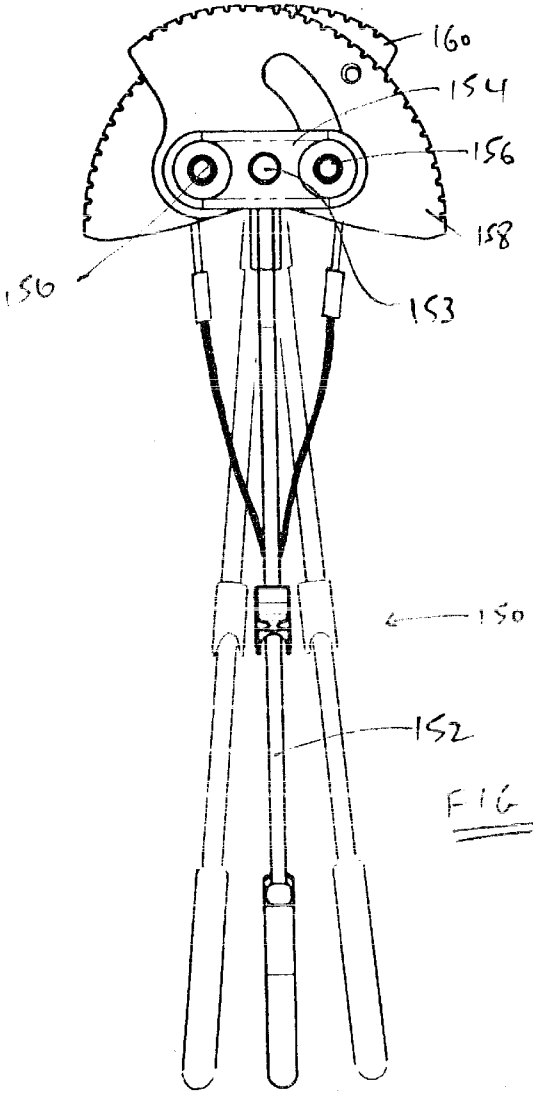

In FIGS. 8 and 9 of the drawings, there is shown twin spindle camming device 150 that has a wire hoop stem 152 having its free ends pivotally mounted at 153 to spindle supports 154. The spindles 156 are supported between the supports and have pivotally mounted thereon two pairs of oppositely oriented cams 158,160. These cams operate in a similar manner to that described for the prior art camming device of FIG. 1.

Figure 10:
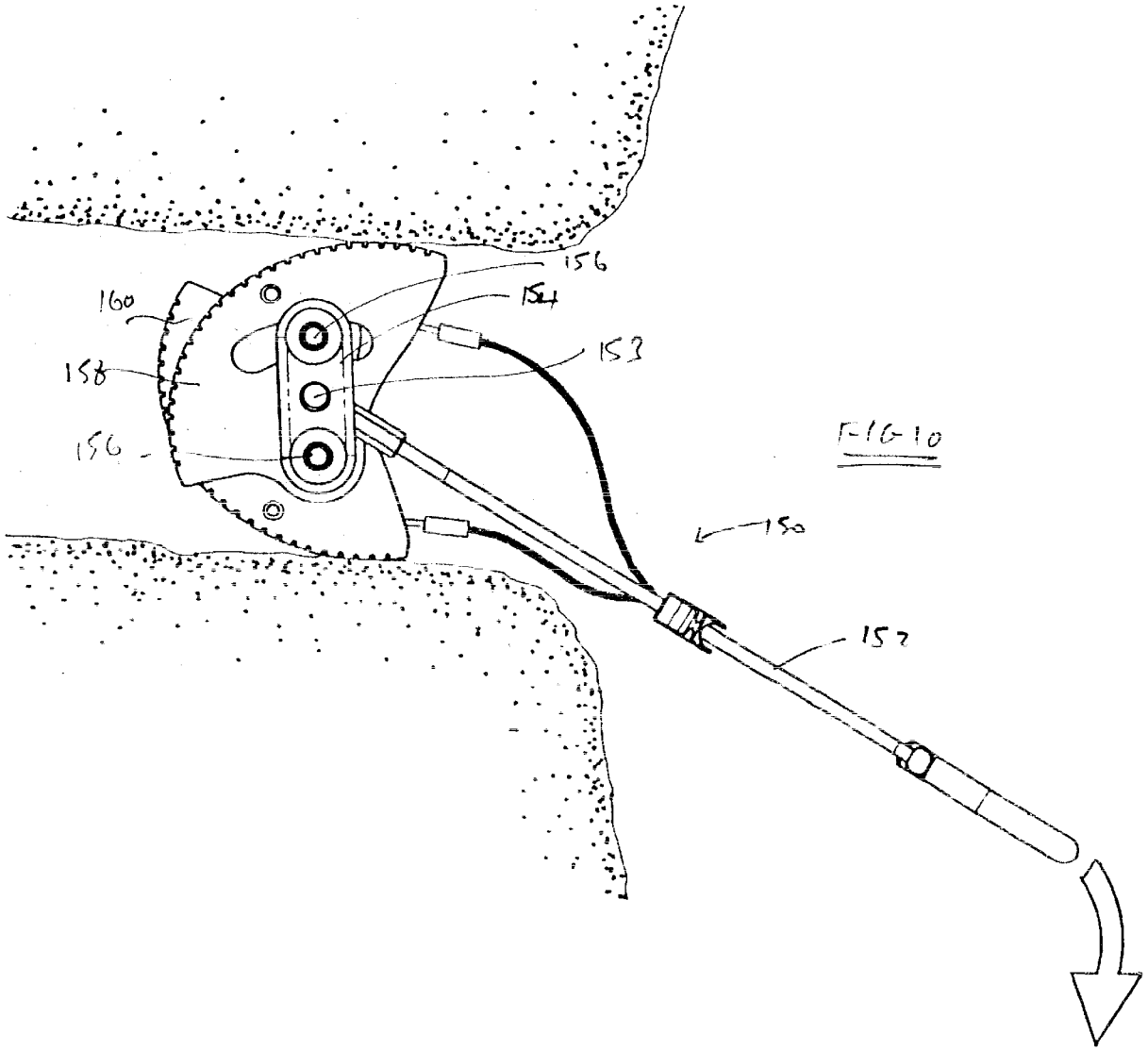
FIG. 10 shows the camming device of FIGS. 8 and 9 inserted into a crack in a rock face.

FIG. 10 of the drawings shows the device 150 inserted in a crack of a rock face. As can be seen, because the stem is able to pivot relative to the spindle supports, less force is exerted on the cams that would otherwise act against the normal camming action.

Figure 11:
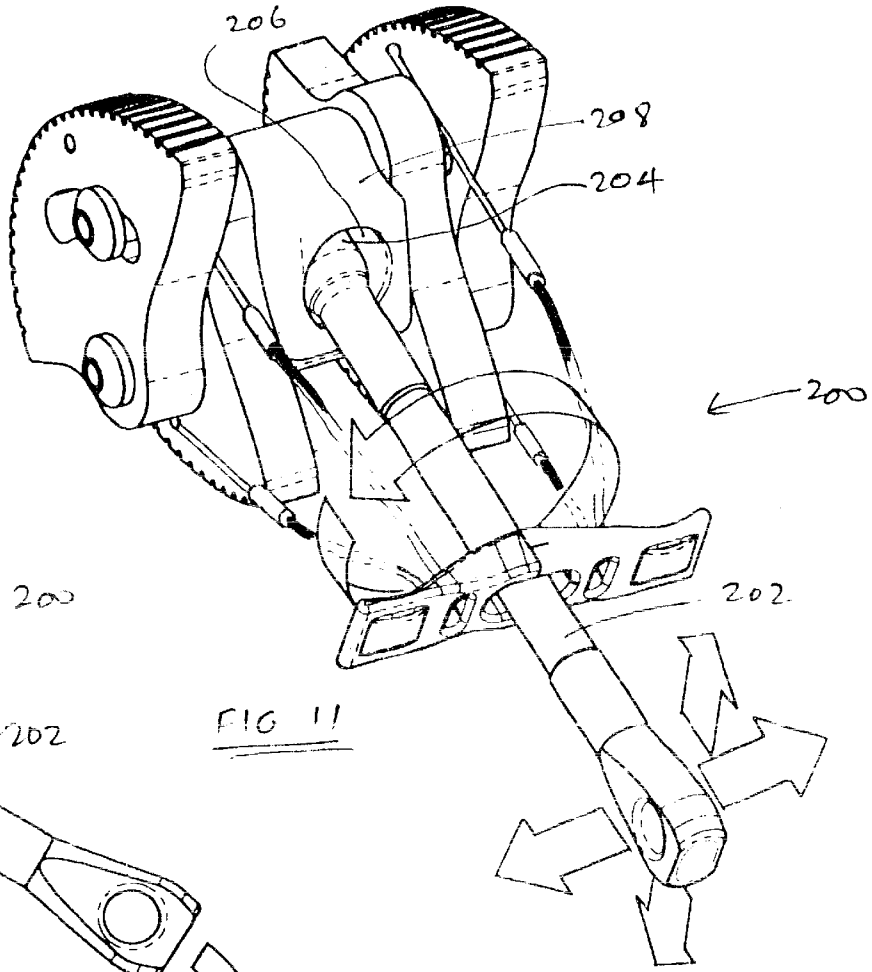
FIG. 11 shows a third camming device according to the invention.
Figure 12:
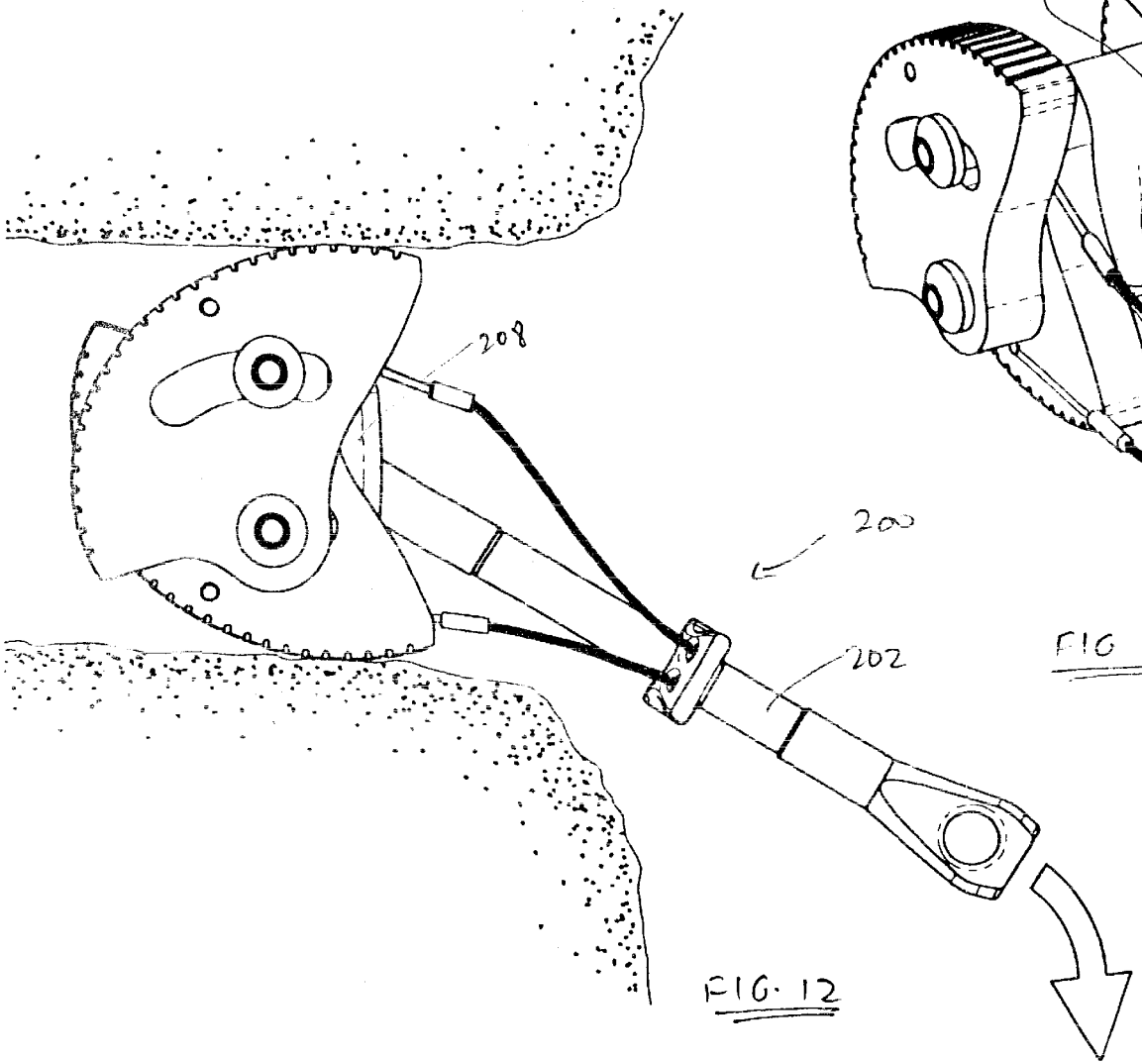
FIG. 12 shows the camming device of FIG. 11 inserted into a crack in a rock face.

Turning to FIGS. 11 and 12 of the drawings, a camming device 200 is shown which is similar to that shown in FIGS. 5 and 6, except that stem 202 has a generally spherical top 204 mounted in a correspondingly spherical hole 206 in spindle support member 208, whereby the stem is able not only to pivot in any direction relative to the spindle support member but also is able to rotate relative thereto.

Figure 13:
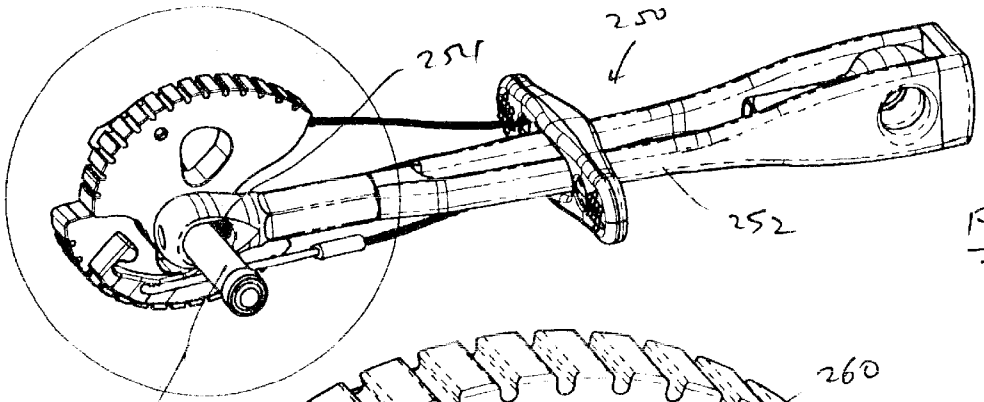
FIG. 13 shows a fourth camming device according to the invention.
Figure 14:
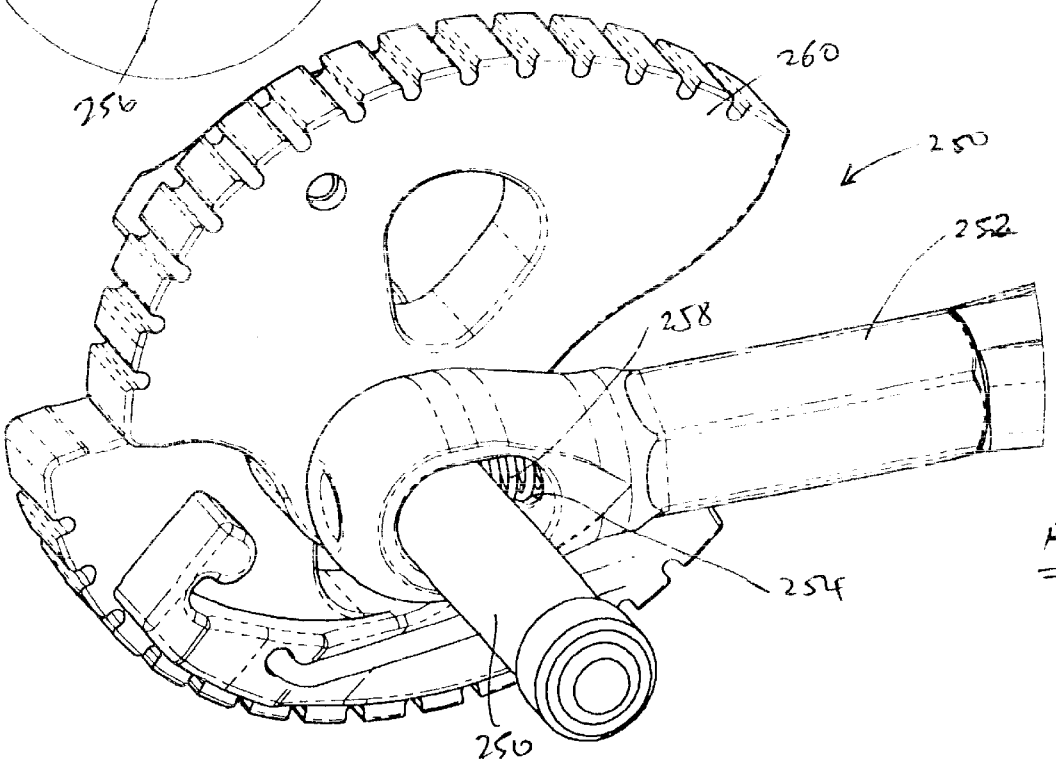
FIG. 14 shows enlarged detail of the device of FIG. 13.

FIGS. 13 and 14 of the drawings show an embodiment in which lateral pivoting of stem 252 of a camming device 250 is achieved by providing in the top of the stem an elongate aperture 254 for cam supporting spindle 256. A spring 258 is mounted in the aperture to bias the stem to a rest position where it is in a plane parallel to the cams 260 only one pair of which is shown.

Figures 15, 16, 17:
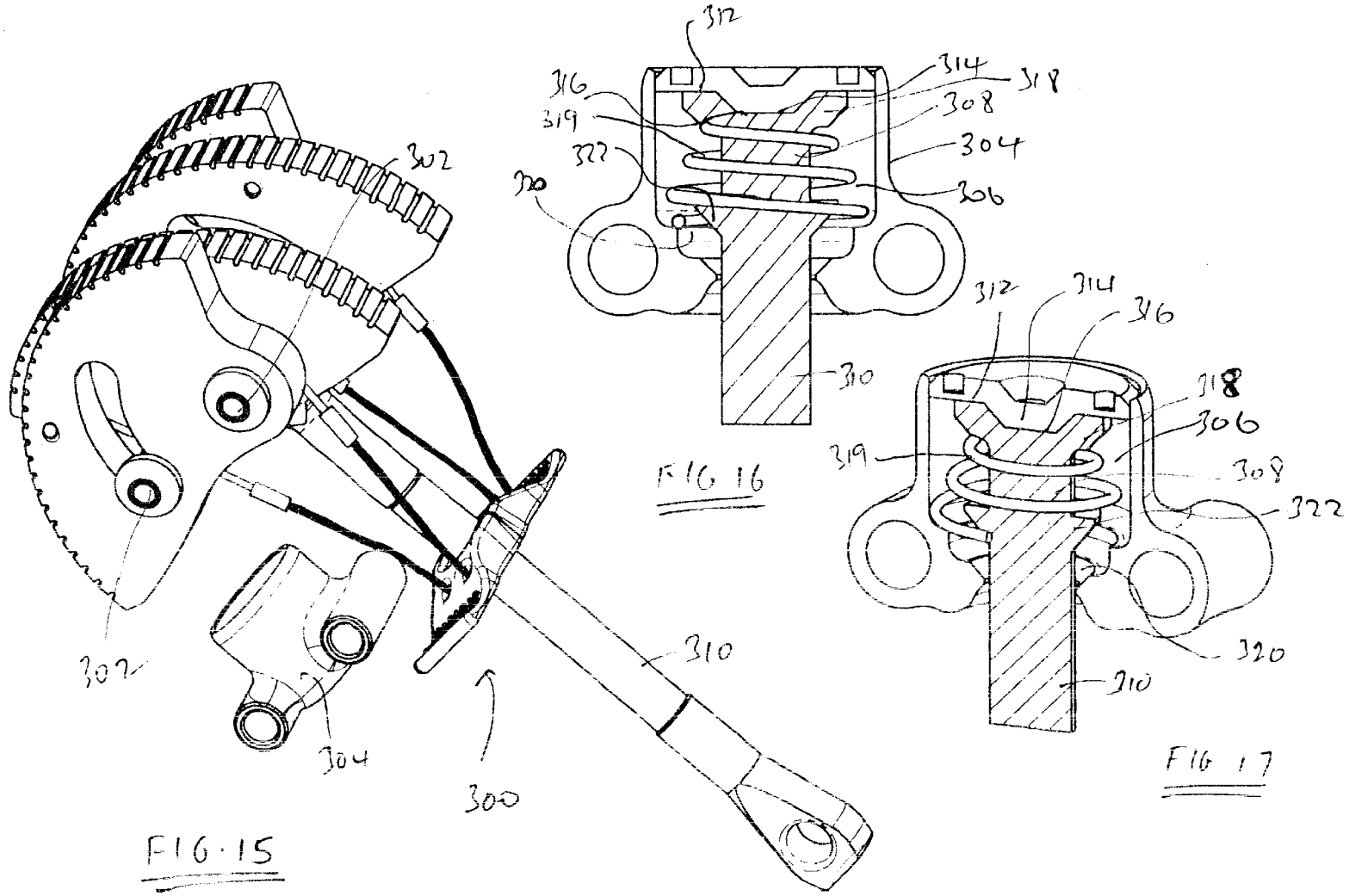
FIG. 15 shows a fifth camming device according to the invention.
FIGS. 16 and 17 are sections through part of the device of FIG. 15.

The ability of the stem to pivot sideways reduces the risk of the camming device walking in a crack Finally in FIGS. 15 to 17 of the drawings, there is shown a camming device 300 in which a pair of cam supporting spindles 302 is mounted through a head member 304. The head member has a cavity 306 in which is retained the head 308 of stem 310. The cavity has a top wall 312 that has a protrusion 314 into the cavity and the head 308 of the stem has a correspondingly shaped recess 316 in a flange 318 of the head. A spring 319 is on the head and acts between the underside of the flange and the periphery of the opening 320 into the cavity to urge the protrusion 314 and the recess 316 into contact for normal operation of the camming device.

When the camming device 300 is positioned in a crack any forces on the stem will cause disengagement of the protrusion 314 and recess 316 and allow the stem to pivot by virtue of the shaping of the opening 320 and a chamfered circumferential rib 322 of the head of the stem. Thus, load applied to the stem will disengage the protrusion and recess, so that the load is not immediately applied to the cams. Thus, there is less likelihood of walking as well as the problem described with reference to FIG. 2 of the drawings with this type of device. When the load pulls the stem so that the rib 322 mates with the bottom of the cavity, the load is then properly transmitted to the cams.

Furthermore, the device of FIGS. 15 to 17 could be produced in such a manner as to allow adjustment of the position of the wall 312 to vary the tension on spring 319 offering a degree of control over the level of additional freedom of movement of the stem.

It is to be noted that, in embodiments provided with spring biasing, such be of sufficient strength to overcome the weight of the stem assembly but insufficient to overcome the holding force produced by the cam springs when side loads are applied to the stem.

What is claimed is:

1. A camming device comprising a stem, at least one spindle connected to the stem by a support member; and a cam member pivotally mounted on the spindle, the cam member adapted to engage walls of a crack or hole and adapted for opposite pivotal movement from a closed position to an open position, means to apply a force to the cam member to urge it to the open position, means for pivoting the cam to the closed position, wherein the stem includes a top portion movably connected to the support member for facilitating movement of at least a major part of the stem about an axis other than an axis of a spindle.

2. A camming device as claimed in claim 1, wherein the spindle is mounted through a head of the stem, the remainder of the stem being pivotable relative to the head.

3. A camming device as claimed in claim 2, wherein said pivoting is in a plane parallel to the cams.

4. A camming device as claimed in claim 2, wherein the stem is pivotable in any direction radially of the axis of the stem.

5. A camming device as claimed in claim 2, wherein the stem is pivotable axially of the stem.

6. A camming device comprising a stem, a single spindle mounted on the stem by a support member, at least two cam members adapted to engage the walls of a crack or hole by their cam profiles pivotally mounted on the spindle and adapted for opposite pivotal movement from a closed position to an open position, means to apply a force to each cam member to urge it to its open position, means for pivoting the cams to the closed position wherein the spindle is mounted through an aperture in the a stem head that is sufficiently large for limited rocking movement of the stem about the spindle and wherein the stem includes a top portion movably connected to the support member for facilitating movement of t least a major part of the stem about an axis other than an axis of the spindle.

7. A camming device as claimed in claim 6, wherein the limited rocking movement is laterally relative to the cams.

8. A camming device as claimed in claim 6, wherein the aperture is elongate along the axis of the stem.

9. A camming device as claimed in claim 6, wherein rocking movement is constrained by spring means or the like between the spindle and one end of the aperture.

10. A camming device as claimed in claim 9, wherein the spring means is between the spindle and the end of the aperture remote from the spindle end of the stem.

11. A camming device comprising a support member at least one spindle mounted on the support member a stem including a top portion; and movably connected to the support member, a cam member pivotally mounted on the spindle, the cam member adapted for opposite pivotal movement from a closed position to an open position, and the cam member lying in an imaginary cam plane, means to apply a force to the cam member to urge it to its the open position, means for pivoting the to the closed position, wherein the stem is top portion of the hoop is pivotally attached to the support member and the hoop is movable in an imaginary plane parallel to the imaginary cam plane.

12. A camming device as claimed in claim 11 wherein the hoop is of wire.

* * * * *

UNITED STATES PATENT AND TRADEMARK OFFICE

CERTIFICATE OF CORRECTION

PATENT NO. : 6,679,466 B2
DATED : January 20, 2004
INVENTOR(S) : Kevin Brown

It is certified that error appears in the above-identified patent and that said Letters Patent is hereby corrected as shown below:

Column 4,
Line 50, “support member; and a” should read -- support member, a --.

Column 5,
Line 10, “position wherein” should read -- position, wherein --.
Line 15, “of t least” should read -- of at least --.

Column 6,
Line 7, “a support member at” should read -- support member, at --.
Line 8, “the support member a” should read -- support member, a --.
Line 13, “to its the” should read -- to the --.
Line 14, “pivoting the to” should read -- pivoting the cam to --.
Line 15, “stem is top portion of the hoop” should read -- stem is in the form of a hoop, the top portion of the hoop --.

Signed and Sealed this

Eighteenth Day of May, 2004

JON W. DUDAS
*Acting Director of the United States Patent and Trademark Office*